US007578502B2

(12) United States Patent
Förch et al.

(10) Patent No.: US 7,578,502 B2
(45) Date of Patent: Aug. 25, 2009

(54) SHEET DELIVERY FOR A PRINTING PRESS

(75) Inventors: Peter Förch, Neustadt (DE); Markus Möhringer, Weinheim (DE); Stefan Mutschall, Östringen (DE); Paul Nicola, Heidelberg (DE); Marius Stelter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 133 days.

(21) Appl. No.: 10/945,366

(22) Filed: Sep. 20, 2004

(65) Prior Publication Data

US 2005/0062219 A1 Mar. 24, 2005

(30) Foreign Application Priority Data

Sep. 18, 2003 (DE) ..... 103 43 208

(51) Int. Cl.
*B65H 29/26* (2006.01)

(52) U.S. Cl. ..... 271/191; 271/268; 271/69; 271/307; 271/308

(58) Field of Classification Search ..... 271/204, 271/206, 85, 228, 267, 268, 277, 69, 306, 271/307, 308, 184, 189, 190, 191
See application file for complete search history.

(56) References Cited

U.S. PATENT DOCUMENTS 5,998,890 A * 12/1999 Sedgewick et al. ..... 310/12
6,398,010 B1 6/2002 Fangmeier
6,398,211 B1 6/2002 Schalk
6,631,898 B2 10/2003 Dobrindt
6,631,901 B2 10/2003 Hess et al.

FOREIGN PATENT DOCUMENTS

| | | | |
|---|---|---|---|
| DE | 292715 | | 6/1916 |
| DE | 7219031 | | 8/1972 |
| DE | 32 26 813 | A1 | 5/1983 |
| DE | 198 37 095 | A1 | 2/2000 |
| DE | 198 46 032 | A1 | 4/2000 |
| DE | 199 21 169 | A1 | 11/2000 |
| DE | 100 47 395 | A1 | 5/2001 |
| DE | 101 26 894 | A1 | 12/2002 |
| JP | 2001-163498 | | 6/2001 |
| WO | WO9310594 | A1 * | 5/1993 |

* cited by examiner

*Primary Examiner*—Patrick H Mackey
*Assistant Examiner*—Jeremy Severson
(74) *Attorney, Agent, or Firm*—Laurence A. Greenberg; Werner H. Stemer; Ralph e. Locher

(57) ABSTRACT

A sheet delivery for a press has a linear guide in which a single holding crossmember (e.g., a gripper bar) is mounted such that it can be moved to and fro periodically. The holding crossmember is mounted in a further linear guide such that it can be moved to and fro periodically along the further linear guide axis as well. The axes of the linear guides are aligned at an angle to each other.

5 Claims, 4 Drawing Sheets

SHEET DELIVERY FOR A PRINTING PRESS

BACKGROUND OF THE INVENTION

Field of the Invention

The present invention lies in the printing technology field. More specifically, the invention relates to a sheet delivery for a press, having a linear guide in which a single holding crossmember is mounted such that it can be moved to and fro periodically.

German patent DE 292 715 describes such a sheet delivery. The device has the disadvantage, however, that its holding crossmember, which is formed as a gripper bar, is able to move only on a comparatively simple movement path. This is unfavorable since, in specific applications, a more complicated movement path of the holding crossmember may be required.

SUMMARY OF THE INVENTION

It is accordingly an object of the invention to provide a sheet delivery for a printing press which overcomes the above-mentioned disadvantages of the heretofore-known devices and methods of this general type and provides for the technical preconditions and facilitates a movement of the holding crossmember following a more complicated movement path.

With the foregoing and other objects in view there is provided, in accordance with the invention, a sheet delivery for a printing press, comprising:

a first linear guide defining a first axis;

a second linear guide defining a second axis enclosing an angle other than zero with the first axis;

a single holding crossmember mounted in the first linear guide and in the second linear guide for periodic to and fro movement along the first axis and the second axis.

In other words, the objects of the invention are achieved with a sheet delivery that has one linear guide in which the single holding crossmember is mounted such that it can be moved to and fro periodically, and a another linear guide in which the single holding crossmember is mounted such that it can be moved to and fro periodically along the other linear guide as well. The axes of the linear guides are aligned at an angle to each other. These imaginary axes are those which determine the guide directions of the linear guides. The sheet delivery according to the invention has the advantage that its holding crossmember is able to carry out a multidimensional movement and that the expenditure on mechanisms required for this purpose is comparatively low.

In a development of the sheet delivery according to the invention which is advantageous with regard to the compact design, the linear guides together form a cross slide.

In a development which is advantageous with regard to the use of the holding crossmember as an aftergripper cooperating with chain conveyors of the sheet delivery, the linear guides are assigned motors for driving the periodic to and fro movements of the holding crossmember, and these motors are driven in such a way that the holding crossmember is moved by the motors along an intrinsically closed circulation path.

The holding crossmember used for holding the sheets can be a suction bar or, preferably, a gripper bar.

Other features which are considered as characteristic for the invention are set forth in the appended claims.

Although the invention is illustrated and described herein as embodied in a sheet delivery for a press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
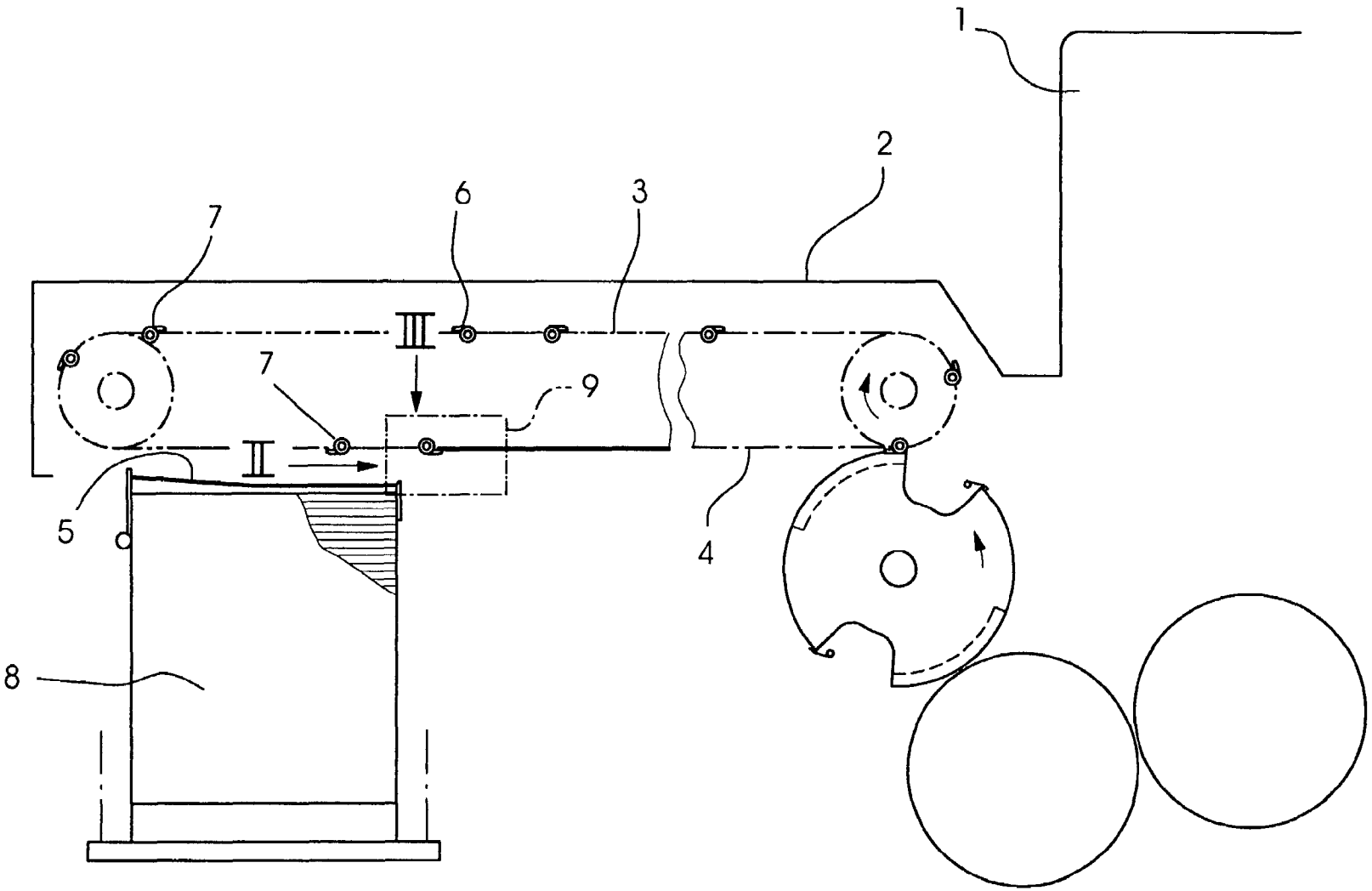
FIG. 1 is a schematic side view of a printing press with a sheet delivery having an auxiliary sheet conveying device according to the invention.

Referring now to the figures of the drawing in detail and first, particularly, to FIG. 1 thereof, there is shown a press 1 having a sheet delivery 2 and a printing unit. The printing unit is an offset printing unit with a printing form cylinder, a blanket cylinder, and an impression cylinder.

The sheet delivery 2 comprises a first chain conveyor 3 and a second chain conveyor 4. In the viewing direction chosen for FIG. 1, the chain conveyors 3, 4 partly hide each other. The first chain conveyor 3 holds each printing material sheet 5 to be delivered firmly at the leading edge of the sheet by means of a leading-edge gripper bar 6 in each case. All the leading-edge gripper bars 6 of the first chain conveyor 3 are carried by a pair of endless chains belonging to the first chain conveyor 3. The second chain conveyor 4 holds each printing material sheet 5 to be delivered firmly at its sheet trailing edge by means of a trailing-edge gripper bar 7 in each case. Each of the trailing-edge gripper bars 7 of the second chain conveyor 4 is fixed by its bar end located on the drive side of the press 1 to a first endless chain of the second chain conveyor 4, and by its bar end located on the operating side of the press 1 to a second endless chain of the second chain conveyor 4. The chain conveyors 3, 4 are therefore equipped with different gripper bar sets. Each of the leading-edge gripper bars 6 of the first chain conveyor 3 is paired with another trailing-edge gripper bar 7 of the second chain conveyor 4 in such a way that each of the printing material sheets 5, during its transport to the delivery stack, is held firmly at the sheet leading edge by one of the leading-edge gripper bars 6 and, at the same time, is held firmly at the sheet trailing edge by one of the trailing-edge gripper bars 7. In this case, the chain conveyors 3, 4 circulate synchronously with each other.

An auxiliary sheet conveying device 9—a so-called aftergripper—belonging to the sheet delivery 2 is disposed upstream of the delivery stack 8, as viewed in the sheet transport direction, and substantially underneath the chain conveyors 3, 4. The auxiliary sheet conveying device 9 is used to guide the sheet trailing edges on a defined path from the second chain conveyor 4 to the delivery stack 8 when the second chain conveyor 4 has already released the sheet trailing edges in each case. The trailing-edge gripper bars 7 therefore transfer the sheet trailing edges one after another to the auxiliary sheet conveying device 9.

Figure 2:
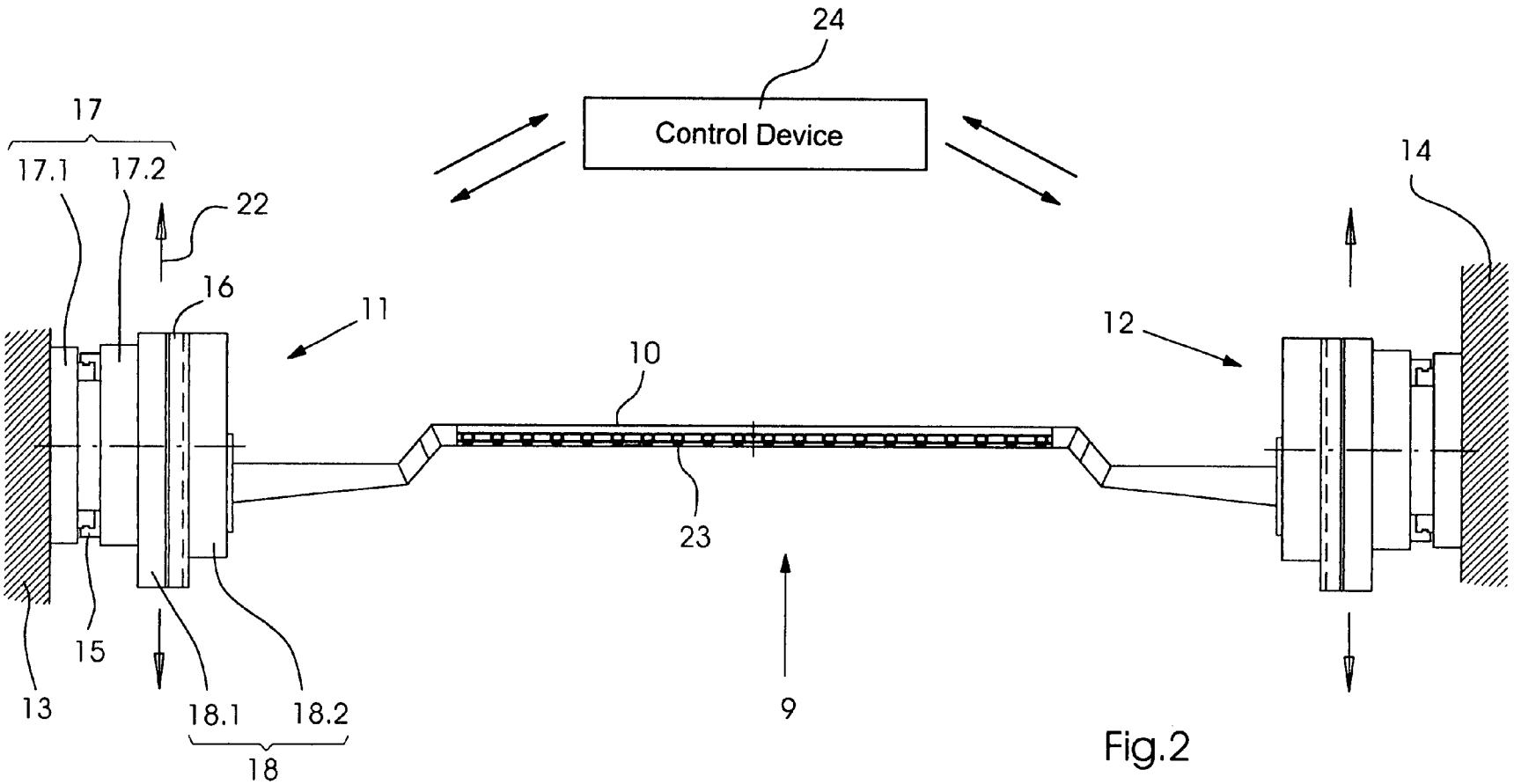
FIG. 2 is a detailed illustration, corresponding to the viewing direction II in FIG. 1, of the auxiliary sheet conveying device.

FIG. 2 shows that the auxiliary sheet conveying device 9 has, as holding crossmember, a gripper bar 10 with grippers 23 provided for clamping the printing material sheet 5 and arranged in a row. The gripper bar 10 is fixed to side walls 13, 14 of a frame of the sheet delivery 2, at its one end via a first cross slide 11 and at its other end via a second cross slide 12.

Since the second cross slide 12 which is arranged on the operating side is constructed identically to the first cross slide 11 arranged on the drive side, the following description of the first cross slide 11 also applies in the transferred sense to the second cross slide 12.

The first cross slide 11 comprises a finite, first linear guide 15 and a finite, second linear guide 16.

Figure 3:
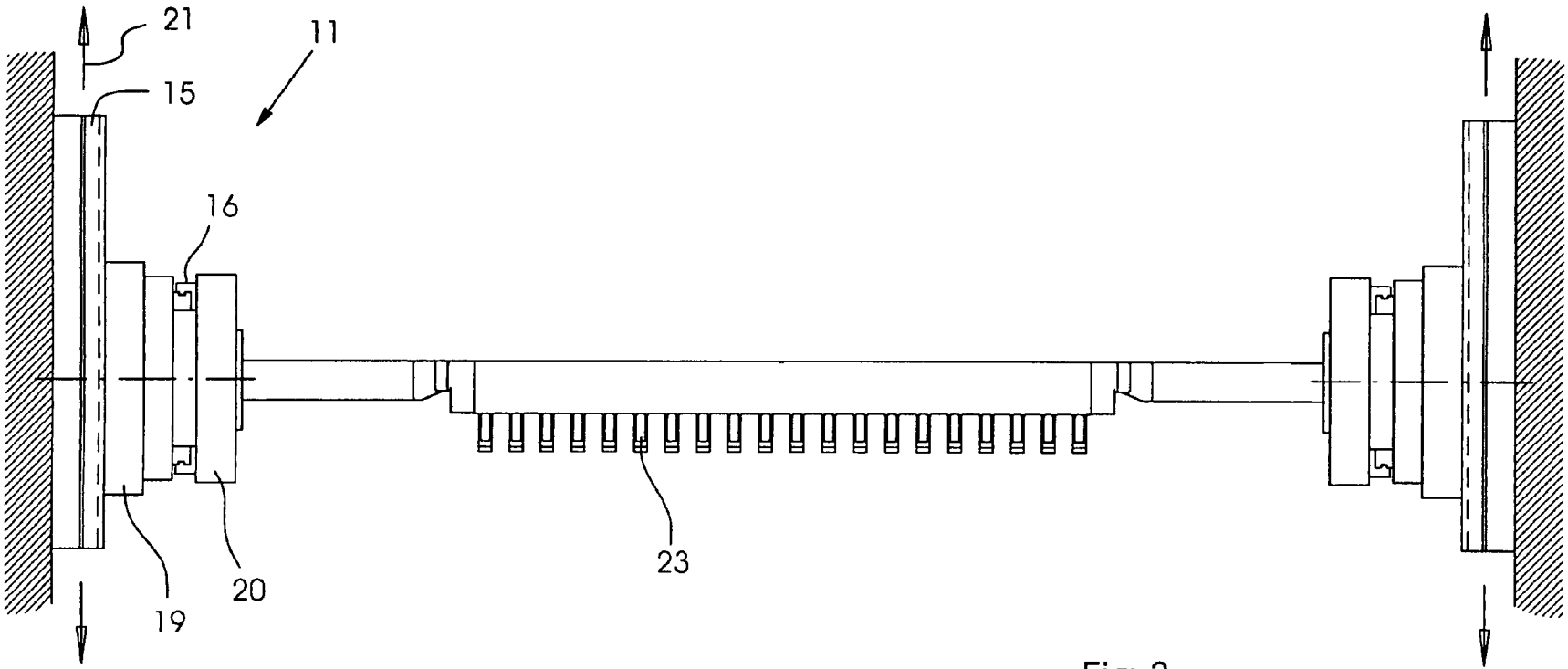
FIG. 3 is a detailed illustration, corresponding to the viewing direction III in FIG. 1, of the auxiliary sheet conveying device.

The gripper bar 10 is therefore mounted as a single holding crossmember such that it can move in the finite, first linear guide 15 and, likewise as a single holding crossmember, such that it can move in the finite, second linear guide 16. The term "finite" in connection with the linear guides 15, 16 means that the respective linear guide 15 or 16 guides the gripper bar 10 from a first reversal point to a second reversal point on one and the same path as back from the second reversal point to the first reversal point. Each of the linear guides 15, 16 has only a single degree of (thrust) freedom of movement and comprises two rails which engage behind each other for security. Guides secured in this way are also designated closed guides. The linear guides 15, 16 are therefore closed prismatic guides and are arranged so as to cross each other, preferably at right angles, the first linear guide 15 extending longitudinally in the horizontal direction (plane of FIG. 3) and the second linear guide 16 extending longitudinally in the vertical direction (plane of FIG. 2).

The first cross slide 11 is assigned a first electric motor 17 with a stator 17.1 and a rotor 17.2, and a second electric motor 18 with a stator 18.1 and a rotor 18.2. The motors 17, 18 are travelling-wave motors, linear drives or moving field motors, where these are all different names for the same type of motor. In addition, the first cross slide 11 comprises a first slide, which will be designated the horizontal slide 19 below, and a second slide, which will be designated the vertical slide 20 below. The stator 17.1 is fixed to the side wall 13 so as to be stationary. The rotor 17.2 and the stator 18.1 are integrated in the horizontal slide 19. The rotor 18.2 is integrated in the vertical slide 20. Accordingly, on one side, the rotor 17.2, the stator 18.1 and the horizontal slide 19 are connected to the side wall 13 via the first linear guide 15 in the manner of a thrust link and, on the other side, the vertical slide 20 and the rotor 19.2 are connected to the horizontal slide 19 via the second linear guide 16 in the manner of a thrust link.

The gripper bar 10 is moved to and fro periodically between the reversal points of the first linear guide 15 along a horizontal x-axis 21 by the moving electromagnetic field of the first motor 17 and, at the same time, is moved to and fro periodically between the reversal points of the second linear guide 16 along a vertical y-axis 22 by the moving electromagnetic field of the second motor 18. The motors 17, 18 have a control link to an electronic control device 24, which drives the motors 17, 18 in such a way that the gripper bar 10 is moved on an intrinsically closed, imaginary circulation path 25 (cf. FIG. 4).

Figure 4:
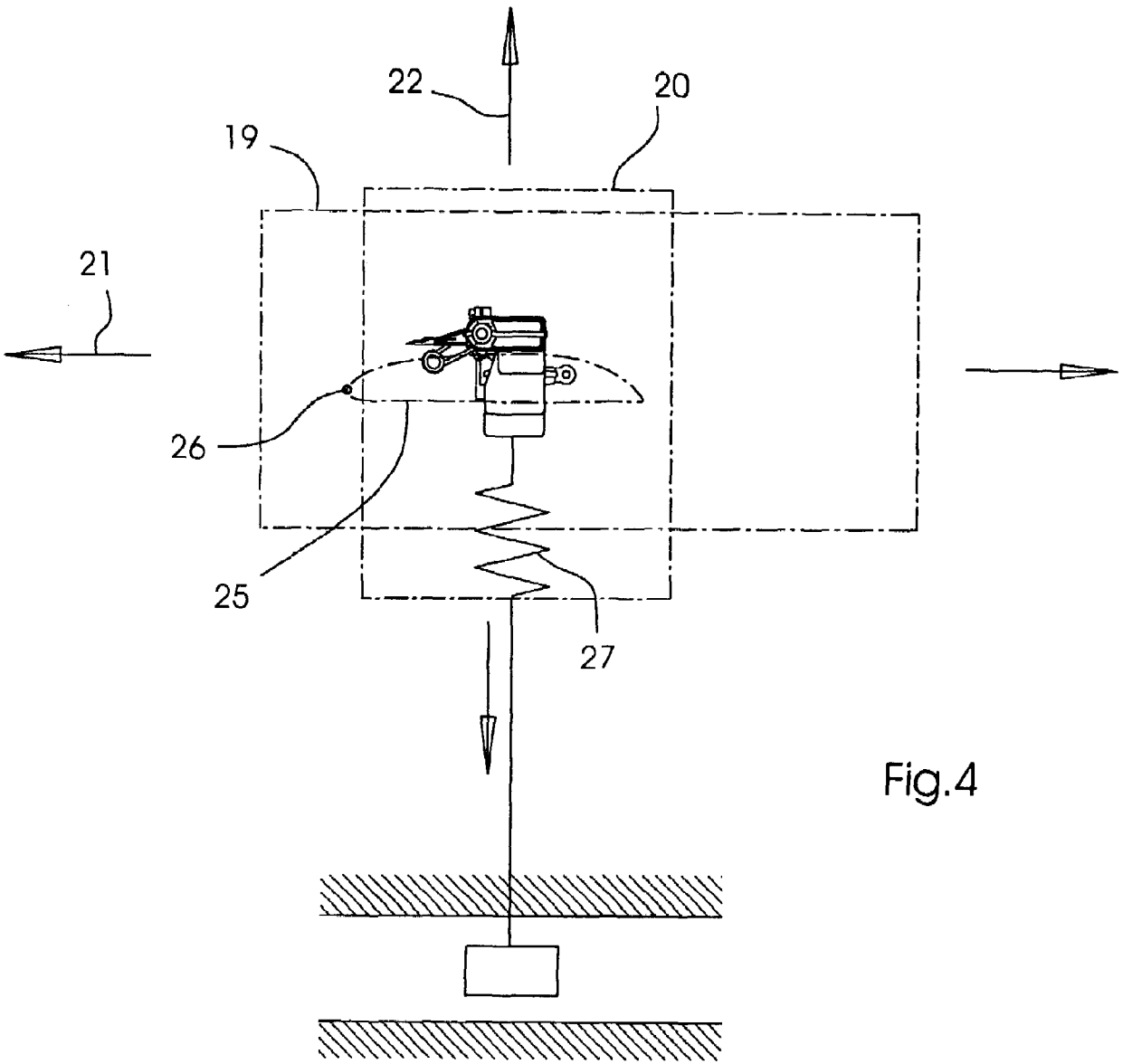
FIG. 4 is a diagrammatic view of a circulation path of a holding crossmember of the auxiliary sheet conveying device.

From FIG. 4, it can be seen that the amplitude of the linear oscillation of the gripper bar 10 carried out along the first linear guide 15 or x-axis 21 is many times greater than the amplitude of the linear oscillation of the gripper bar 10 carried out along the second linear guide 16 or y-axis 22. In addition, by using the movement arrow symbols shown in FIG. 4, it becomes clear that the gripper bar 10 circulates counterclockwise with respect to FIG. 4 and thus also with respect to FIG. 1. The control device 24 therefore drives the motors 17, 18 in such a way that the resultant of the two orthogonal movement components (horizontal linear oscillation along first linear guide 15, vertical linear oscillation along second linear guide 16) is the circulation path 25. The circulation path 25 is configured geometrically in such a way that, during each circulation, the gripper bar 10 firstly approaches the lower run of the second chain conveyor 4 and therefore the sheet trailing edge held firmly in the trailing-edge gripper bar 7 and grips said sheet trailing edge after the trailing-edge gripper bar 7 has released the sheet trailing edge, then guides the latter to a sheet discharge point 26 located on the circulation path 25, then itself releases the sheet trailing edge at this sheet discharge point 26 and ultimately returns into its starting position again on the lower section of the circulation path 25, without holding a printing material sheet firmly in the process. The sheet discharge point 26 is a point on the circulation path 25 placed particularly close to the delivery stack 28.

Since the second motor 18 moves the gripper bar 10 periodically away from the chain conveyors 3, 4 and then toward the latter again and, in the process, moves very close to the lower chain runs of the chain conveyors 3, 4 occupied by the gripper bars 6, 7, a collision prevention device is provided which ensures that, in the event of power failure or a failure of the moving field in the second motor 18, the gripper bar 10 is automatically withdrawn from the chain conveyors 3, 4, so that the gripper bar 10 of the auxiliary sheet conveying device 9 cannot collide with the gripper bars 6, 7 of the chain conveyors 3, 4. Provided as the aforesaid collision prevention device is a spring 27, which acts on the vertical slide or on the gripper bar 10 itself and which attempts to pull the gripper bar 10 downward and thus away from the chain conveyors 3, 4. During undisrupted machine running, the second motor 18 overcomes the restoring force of the spring 27 during each movement of the gripper bar 10 toward the chain conveyors 3, 4.

This application claims the priority, under 35 U.S.C. § 119, of German patent application No. 103 43 208.6, filed Sep. 18, 2003; the entire disclosure of the prior application is herewith incorporated by reference.

We claim:

1. A sheet delivery for a printing press, comprising:

a first linear guide defining a first axis;

a second linear guide defining a second axis enclosing an angle other than zero with said first axis;

a single holding crossmember mounted in said first linear guide and in said second linear guide for periodic to and fro movement along said first axis with a first amplitude and along said second axis with a second amplitude; and motors respectively assigned to said first and second linear guides and configured to drive the periodic to and fro movements of said holding crossmember, said motors being travelling-wave motors; and a control device connected to said motors for controlling said motors;

said control device configured for driving said motors to move said holding crossmember along an intrinsically closed circulation path;

said control device, said first and second linear guides and said motors being configured so that said second amplitude is a plurality of times greater than said first amplitude.

2. The sheet delivery according to claim 1, wherein said first and second linear guides together form a cross slide.

3. A sheet delivery for a printing press, comprising:

a first linear guide defining a first axis;

a second linear guide defining a second axis enclosing an angle other than zero with said first axis;

a single holding crossmember mounted in said first linear guide and in said second linear guide for periodic to and fro movement along said first axis with a first amplitude and along said second axis with a second amplitude;

motors respectively assigned to said first and second linear guides and configured to drive the periodic to and fro movements of said holding crossmember, said motors being travelling-wave motors; and a control device connected to said motors for controlling said motors;

said control device configured for driving said motors to move said holding crossmember along an intrinsically closed circulation path;

said control device, said first and second linear guides and said motors being configured so that said second amplitude is a plurality of times greater than said first amplitude, said first linear guide and said first amplitude having a horizontal orientation, and said second linear guide and said second amplitude having a vertical orientation.

4. The sheet delivery according to claim 1, wherein said holding crossmember is a gripper bar.

5. The sheet delivery according to claim 3, wherein said motors drive said holding crossmember to move along an intrinsically closed circulation path.

* * * * *